United States Patent [19]

Chastan-Bagnis et al.

[11] Patent Number: 4,921,605

[45] Date of Patent: May 1, 1990

[54] APPARATUS TO DEPOLLUTE BODIES OF WATER

[76] Inventors: Lucien Chastan-Bagnis, 21, Avenue Isola-Bella; Alain Chastan-Bagnis, 20, Avenue de Vallauris, both of 06400 Cannes, France

[21] Appl. No.: 199,299

[22] Filed: May 26, 1988

Related U.S. Application Data

[63] Continuation of Ser. No. 874,713, Jun. 16, 1986, abandoned.

[30] Foreign Application Priority Data

Jun. 14, 1985 [FR] France ..... 85 09195

[51] Int. Cl.[5] ..... C02F 1/40

[52] U.S. Cl. ..... 210/115; 210/135; 210/242.3; 210/923

[58] Field of Search ..... 210/115, 119, 123, 134, 210/135, 137, 242.1, 242.2, 242.3, 242.4, 923; 114/123, 270

[56] References Cited

U.S. PATENT DOCUMENTS

| | | | |
|---|---|---|---|
| 3,425,556 | 2/1969 | Völker | 210/115 |
| 3,434,444 | 3/1969 | Caddick | 210/923 |
| 3,595,392 | 7/1971 | Markel | 210/251 |
| 3,651,943 | 3/1972 | Di Perna | 210/242.2 |
| 3,731,813 | 5/1973 | Tipton | 210/923 |
| 3,823,828 | 7/1974 | Derzhavets et al. | 210/242.3 |
| 3,966,615 | 6/1976 | Petchul et al. | 210/242.1 |
| 4,008,156 | 2/1977 | Chastan-Bagnis | 210/242.1 |
| 4,108,773 | 8/1978 | Macaluso | 210/522 |
| 4,265,757 | 5/1981 | Ivanoff | 210/242.3 |
| 4,399,040 | 8/1983 | Ayers et al. | 210/242.3 |
| 4,597,863 | 7/1986 | Rymal, Jr. | 210/242.3 |

FOREIGN PATENT DOCUMENTS

| | | | |
|---|---|---|---|
| 0031610 | 7/1981 | European Pat. Off. . | |
| 2613940 | 10/1976 | Fed. Rep. of Germany | 210/923 |
| 2819521 | 11/1979 | Fed. Rep. of Germany | 210/242.3 |
| 2502207 | 9/1982 | France . | |
| 53-87574 | 2/1978 | Japan . | |
| 55-22574 | 2/1980 | Japan . | |
| 55-45935 | 3/1980 | Japan . | |
| WO80/00721 | 4/1980 | PCT Int'l Appl. . | |
| 742347 | 12/1955 | United Kingdom | 210/242.3 |

*Primary Examiner*—Richard V. Fisher
*Assistant Examiner*—Christopher Upton
*Attorney, Agent, or Firm*—Hoffman, Wasson, Fallow & Gitler

[57] ABSTRACT

An apparatus to clean or depollute surfaces or layers of water. The apparatus has at least one channel (12) which withdraws a stream of water at the front of the apparatus and discharges the water at the rear of the apparatus after cleaning or depollution. The water can be discharged through two conduits or tunnels (18), which diverge relative to each other. The flow of the stream of water through the channel (12) is caused by at least one propellor (20) driven by a motor which can be hydraulic.

7 Claims, 4 Drawing Sheets

1
11
26
32
35
36
37
38
39
40
41
42
43
44
45
46

APPARATUS TO DEPOLLUTE BODIES OF WATER

This is a continuation of application Ser. No. 874,713; filed June 16, 1986, now abandoned.

BACKGROUND OF THE INVENTION

The present invention relates to cleaning and decontamination apparatus of simple and economical construction, which allows efficient cleaning of bodies of water such as lakes or seashores by collecting all wastes which are not miscible in water, whether their density is less, than, equal to, or greater than, that of the water.

SUMMARY OF THE INVENTION

In accordance with the preferred embodiment of the invention, the channel has a section which progressively diminishes and discharges the water at the back of the apparatus through two discharge conduits which diverge relative to each other, and inside each of which is a propeller driven by a motor, preferably hydraulic.

According to this preferred embodiment of the invention, the ends of the diverging discharge conduits at the back of the apparatus are advantageously provided with deflectors in the shape of arcs of circles which permit deflecting the jet or current of water discharged from the apparatus, in an adjustable manner, in a direction which causes the apparatus to move in the opposite direction.

In the preferred embodiment, the lower wall of the channel has near its rear portion, an opening provided with an adjustable shutter or valve which allows water passing below the apparatus to be sucked up or directed into the channel so as to increase the flow of water discharged at the rear by the diverging conduits.

The channels has, on its upper wall near the channel inlet, a skimming or tap-off channel which directs and conducts the upper layer of the stream of water and the floating liquid wastes floating thereon into a decanting or separating chamber at the upper portion of which the floating wastes (such as hydrocarbons) accumulate, the lower portion of this chamber being provided with a water evacuation duct which communicates with and discharges into the water stream flow channel at a location downstream from the location of the skimming channel where the upper layer of the stream is drawn off. The stream of water, at the location where the evacuation duct enters the water stream channel, has a greater velocity than at the point at which its upper layer was withdrawn or skimmed to be fed to the decanting member.

During operation, and when it becomes necessary, the upper portion of the decantation chamber is connected to a source of reduced pressure or vacuum which permits bringing or maintaining the liquids at a determined level in the decanting chamber.

This achieves, in a particularly simple and efficient manner, the separation of the floating liquids which collect at the top of the decanting chamber from which they can be extracted by any device, while the water flowed into the decanting chamber is automatically extracted by the evacuation duct.

The skimming channel which withdraws the upper layer of the liquid stream has an elongated section which is of the length of the front side of the decanting chamber, the upper layer of the liquid stream on which the impurities float being brought into the decanting chamber near the front wall.

The water evacuation duct has a relatively small cross section in comparison with that of the decanting chamber and its inlet and is located near the center of this chamber.

Conforming to the invention, it is possible to regulate the evacuation of the floating liquids which assemble at the top of the decanting chamber by means of a contact switch provided with a float which has the double characteristic that it floats on top of the water and that it sinks into the layer of the floating liquid.

The channel in which the liquid stream circulates has a working section which progressively diminishes between the mouth of the skimming channel which leads to the decanting chamber at the point of arrival of the evacuation duct which brings the water from the decanting chamber back into the channel so as to create a higher speed of water flow at this latter point.

In one variation, it is possible to achieve the difference in speed needed for the evacuation of the water from the decanting chamber by means of an adjustable regulator which allows water coming from below the apparatus to enter the channel and the point at which the water evacuation duct from the decanting chamber enters.

The ends of the diverging conduits which discharge the water at the back of the apparatus are provided with deflectors in the form of arcs of circles which serve to deflect the path of the current or jet of water discharged from the apparatus in an adjustable manner in a direction which causes the apparatus to move in the opposite direction.

The apparatus can also be directed or steered in any direction by adjusting the deflectors to the right and left of the apparatus. Because of the existence of the two diverging conduits, the apparatus is perfectly stabilized along its path and it is very easy to maneuver, even in reverse, due to the two reflectors.

According to the preferred embodiment of the invention, the evacuation duct which withdraws the water contained in the decanting chamber and feed or returns it to the channel for the liquid stream is provided with a choke or valve which allows the flow to be varied.

The apparatus advantageously has two floats, one located on either side, the front and/or back of each float being able to be raised or lowered with respect to the apparatus so as to allow the depth and inclination of the apparatus to be adjusted to ensure the correct formation of the liquid stream carrying the floating impurities into the channel.

Conforming to the invention, such regulation of the float means is advantageously obtained by means of hydraulic cylinders, one at each end of each of the float means, the front hydraulic cylinders being connected, and the rear hydraulic cylinders being advantageously interconnected, to prevent uneven tilt which could cause warping of the apparatus. The float means is constituted of sealed tanks which could be ballasted.

According to the preferred embodiment of the invention, each of the float means is constituted of hollow buoyant wheels, possibly connected by caterpillar threads which can be driven in rotation to allow the apparatus to move on land, and the float means constituted of the hollow wheels then being pushed downwardly by jacks or similar devices.

The apparatus has in front of the channel receiving the liquid stream, a grill or grating for separating and retaining solid wastes. A hinged comb whose teeth engage in the grill bars ensures, during its downward movement, the disengagement of solid wastes which can then accumulate toward the top of the grill. Then the comb moves forward and up to catch solid wastes accumulated on the front of the grill and deposit the solid wastes in a receptacle located on the deck of the apparatus, behind the grill.

According to the preferred embodiment of the invention, air is injected into each of the diverging legs of the liquid stream at a point near where the water is discharged from the apparatus so as to oxygenate the water.

In another embodiment, for the purpose of removing wastes having a density greater than that of the surface water, there can be positioned at the front of the apparatus according to the invention, an open top tank having an open side or rear portion by which it joins the mouth of the channel carrying the liquid stream, the tank being provided with at least one articulated tube able to reach downwardly to the bottom of the body of water, the ejection of the stream of water by motors located in the diverging conduits at the back of the apparatus causing suction into the tube of a current of water which draws up the wastes resting on the bottom of the receptacle, the opening of which is located opposite the outlet of the tube, captures the wastes and sends them through a pipe within which a pump sucks up a portion of the water which sucks up the wastes while most of the water sucked up by the tube and which does not contain any wastes flow out through the channel to the back of the apparatus.

In another embodiment, the device may be fitted with two floats which are located on either side of the tank and which can tilt around a horizontal axis so as to vary the elevational position of the device for sucking up the heavier-than-water wastes so as to easily position this device at the front of the apparatus when used to decontaminate and remove wastes from the bottom of the body of water.

In order to make the invention better understood, there will now be described by the way of illustration and without any limiting character, one embodiment taken as an example and shown on the attached drawings.

DETAILED DESCRIPTION OF THE PREFERRED EMBODIMENT

Figure 1:
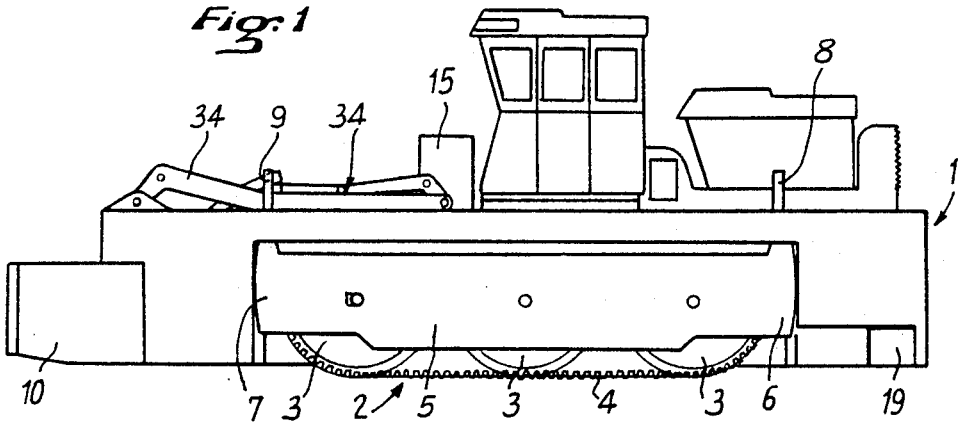
FIG. 1 is a schematic view in side elevation showing one embodiment of an apparatus conforming to the invention, the floats of which are constituted of wheels provided with caterpillar treads.
Figure 2:
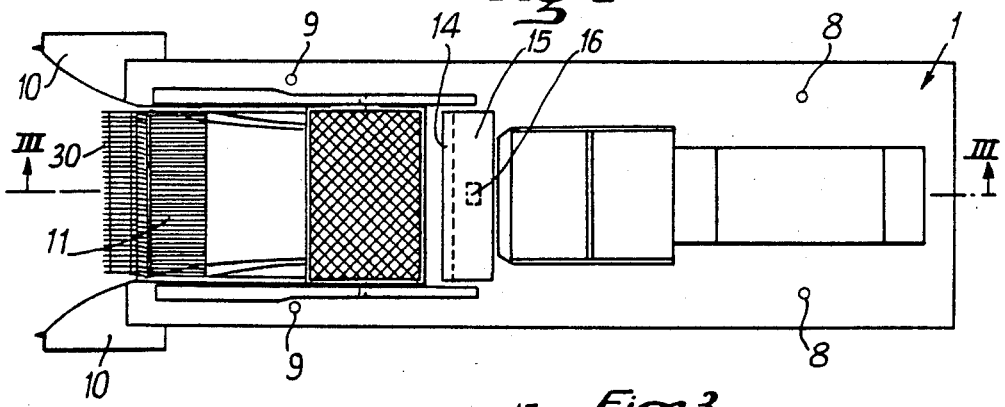
FIG. 2 is a top view of the apparatus of FIG. 1.

One embodiment of the apparatus according to the invention is shown schematically on FIGS. 1–5.

The body or frame 1 of the apparatus supports on either side, float means 2 which in this particular case are constituted of three buoyant hollow wheels 3 connected by a caterpillar thread 4. These wheels 3 are mounted on a support 5 having ends 6 and 7, rounded in shape, which can move up or down independently of each other with respect to body 1 of the apparatus by means of cylinders or jacks 8 and 9 shown schematically and located above the body of the apparatus.

It will be understood that, in view of the fact that the hollow wheels 3 play an important role in the buoyancy of the apparatus, the depth position of the apparatus can be varied by adjusting the jacks 9.

Two detachable caissons 10 with converging inner sides are placed at the front end of the apparatus so as to direct or channel the wastes on the surface of the water toward the intake of the channel which causes the liquid stream or vein to move from the front to the back of the apparatus.

Figure 3:
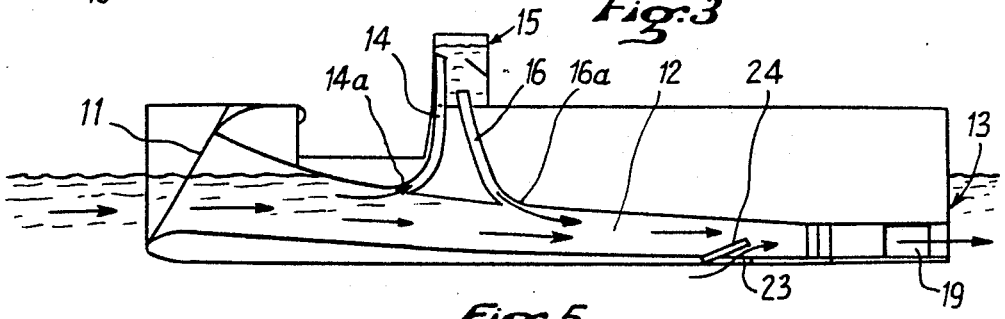
FIG. 3 is a view in section taking along line III—III of FIG. 2.
Figure 5:
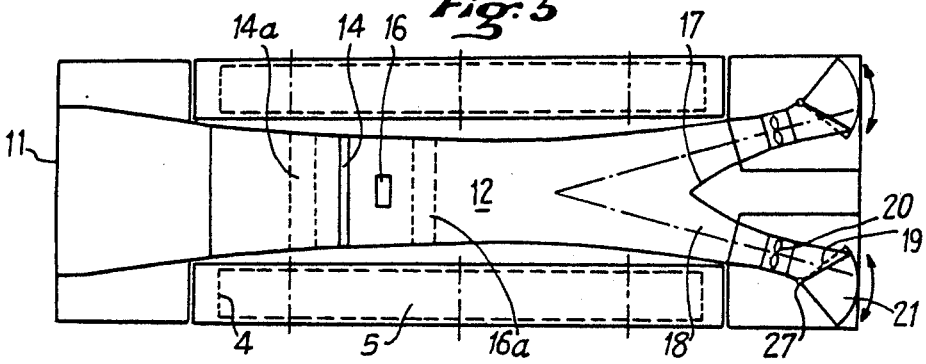
FIG. 5 is a schematic top view of the liquid stream guiding channel of the apparatus of FIG. 1–4.

Caissons 10 converge toward a grill 11 which is placed across the mouth or inlet of channel 12, and the shape of which can be clearly seen on FIGS. 3 and 5.

FIG. 3 shows that channel 12 has a height which decreases progressively between intake grill 11 and the back or stern 13 of the apparatus.

Skimming channel 14 withdraws the upper layer of the liquid stream to bring it into decanting chamber 15 in the upper part of which is accumulated the floating impurities, while the water is returned to the liquid stream by evacuation duct 16 which leads, at location **16*a*, to channel 12 at a point located downstream from the point 14*a*** at which the upper layer of the stream is drawn off.

FIG. 5 shows the channel 12 has a width which diminishes progressively between grill 11 and the point 17 at which it separates into two conduits 18 which diverge relative to each other and have discharge ends at 19 laterally spaced at the back of the apparatus.

FIG. 5 also shows propellers 20 driven by hydraulic motors, not shown, and which are located in each of the conduits 18 to ensure the flow of the liquid stream.

Jet deflectors constituted of cylinder segments 21 can, by pivoting around axis 22, either allow the liquid stream to flow in the axis of the two diverging conduits 18, or direct the two halves of the liquid stream laterally or even toward the front of the apparatus.

Of course it is possible to direct or steer the apparatus at will by adjusting the position of deflectors 21 which can be activated independently of each other and which, when they bring the two halves of the liquid stream back toward the front of the apparatus, can drive the apparatus in reverse.

Due to the fact that liquid stream 12 is divided toward the rear into two diverging liquid streams in the conduits 18, the apparatus has great stability and great maneuverability even in bodies of water with significant current.

FIG. 3 shows schematically an inlet 23 located in the lower wall of the channel which can be regulated by a shutter 24 so as to draw off water from under the apparatus to ensure an ejection of a significant flow of water through diverging conduits 18, without increasing the speed of circulation of the stream of water at the intake of channel 12 beyond that which is necessary for good collection of wastes in the water at the water surface.

Figure 6:
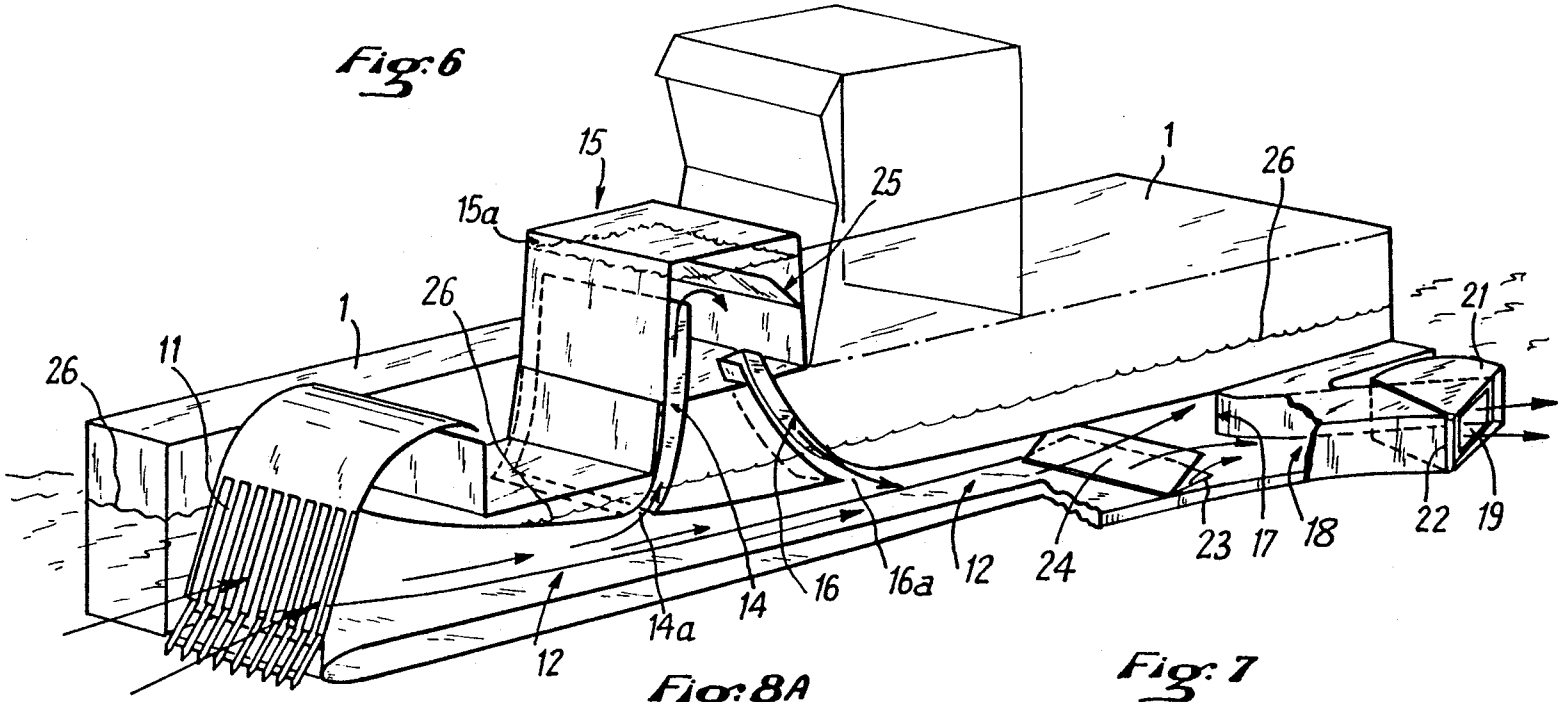
FIG. 6 is a schematic view in perspective of the apparatus shown on the preceding FIGS.
Figure 7:
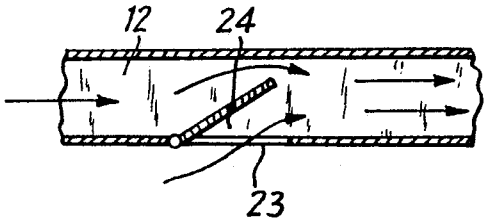
FIG. 7 is a view in section of the opening and shutter which allow water to be drawn off from under the apparatus to be introduced into the stream flowing through the apparatus.

The perspective view of FIG. 6, which has some portions removed along the median longitudinal plane of the apparatus, for purposes of illustration, shows channel 12 which divides at the back of the apparatus into two separate conduits 18, starting at point 17. FIG. 6 also shows skimming channel 14 which withdraws the upper layer of the liquid stream at 14*a* to bring it into decanting chamber 15, from which the water which accumulates in the lower part of the chamber escapes through evacuation duct 16 to come out at duct outlet 16*a* further back in channel 12.

FIG. 6 shows schematically how hydrocarbons or other lighter-than-water impurities accumulate at 15*a* at the upper region of the decanting chamber 15 while, according to the preferred embodiment of the invention, a deflector 25 is placed on the wall of the chamber opposite to the outlet of skimming channel 14 to prevent hydrocarbons 15*a* from being sucked in again by evacuation duct 16.

FIG. 6 shows that the water-line 26, or height of the apparatus in the water, can easily be regulated by means of float 2 so that it is located slightly above the mount 14*a* of skimming channel 14.

Figure 9:
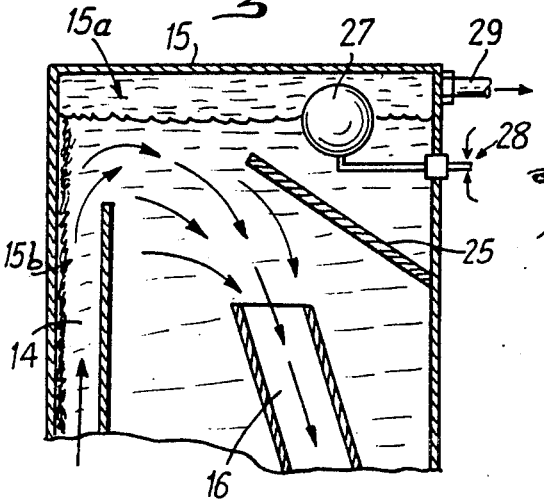
FIG. 9 is a schematic view in section on an enlarged scale, showing how the lighter-than-water liquid impurities are collected at the upper part of the decanting chamber.

FIG. 9 shows, in greater detail, a sectional view of decanting chamber 15. The skimming channel 14 which diverts the upper layer of the liquid stream contains a layer of floating impurities such as hydrocarbons which accumulate at 15*a* at the upper part of chamber 15. The water which remains in the lower part of the chamber 15 is sucked down by evacuation duct 16 because the end 16*a* of this duct is lower that the outlet 15*a* of the skimming channel.

FIG. 9 shows that float 27, whose density is such that it floats in the water of the chamber and sinks in hydrocarbons 15*a*, acts on a contact switch 28, to activate a pump which evacuates hydrocarbons 15*a* through pipe 29 when the amount of hydrocarbons collected in the upper layer of the decanting chamber exceeds a predetermined height.

During operation, and when it becomes necessary, the upper portion of the decanting chamber 15 is connected to a source of reduced pressure or vacuum, not shown in the drawings, which permits bringing or maintaining the liquids at a determined level in the decanting chamber 15.

Conforming to the invention, it is also useful to provide duct 16 with a choke regulator, now shown, which regulates the flow in channel 14 and duct 16 so as to obtain optimal decantation conditions.

Figure 10:
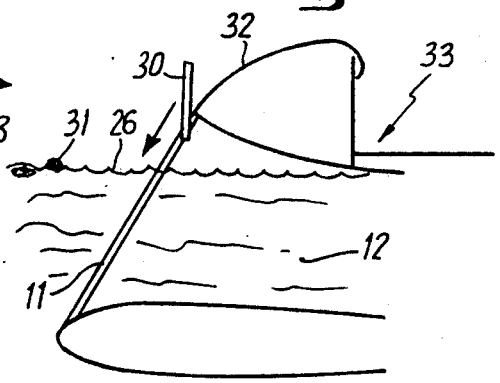
FIGS. 10–12 are schematic views in side elevation of the movements of the comb which cleans the grill located in front of the channel through which the liquid stream flows.
Figure 11:
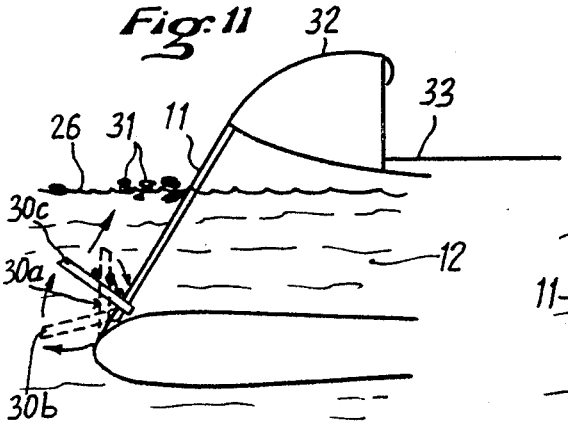
Figure 12:
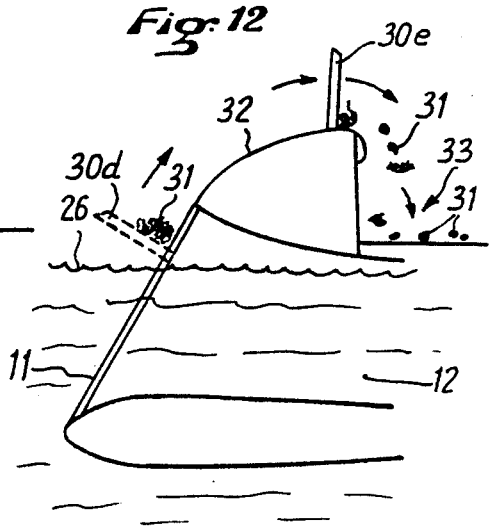

FIGS. 10 to 12 show the movement of comb 30 with respect to grill 11, in order to both ensure cleaning of the grill and convey solid floating wastes 31 over spillway 32 in receptacle 33 from which they can later be removed.

Comb 30 controlled by any mechanism, for example by means of levers and cams, moves downwardly as shown on FIG. 10 with the ends of its teeth between grate bars 11 to disengage wastes such as algae or seaweed.

After reaching the bottom part of the grill, comb 30 pivots clockwise to positions 30*b*, 30*a* then 30*c* successively, in order to collect heavier-than-water wastes which have accumulated on grill 11 and to lift them upwardly as shown by the arrow.

During this upward movement, the comb 30 can also collect wastes 31 which float on the surface 26 of the water by lifting them over the spillway 32 and deposit them in receptacle 33.

FIG. 1 shows the mechanism which provides movements of the comb 30 and, extraction of a bucket, not shown, located in receptacle 33 to place collected waste 31 outside the apparatus.

It will be seen that, by means of this comb arrangement, it is possible to keep grill 11 constantly clean by preventing solid impurities from penetrating channel 12, and also recover in receptacle 33, the solid wastes 31 which accumulate either against the grill 11 or on the surface of the water.

Figure 8A:
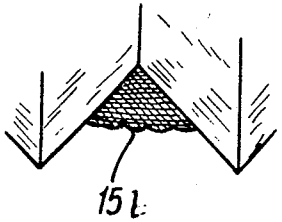
FIG. 8A is an enlarged view of portion VIII of FIG. 8.
Figure 8:
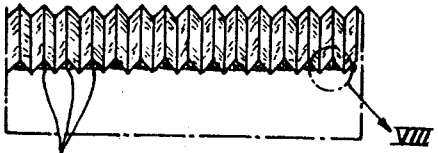
FIG. 8 is a front view of one particular embodiment of the upper wall of the inlet for the liquid stream.
Figure 4:
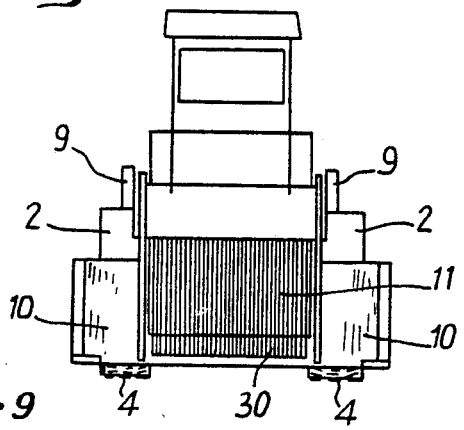
FIG. 4 is a front end view of the apparatus of FIG. 1.

FIG. 8 shows schematically a sectional view of one preferred embodiment of the upper wall of channel 12, near mouth 14*a* of skimming channel 14.

Conforming to this embodiment, the upper wall of channel 12 has, between grill 11 and mouth or inlet 14*a* of the skimming channel, an undulating or zig-zag section which allows the collection of the liquid impurities floating on the liquid stream inside the apparatus so as to facilitate the skimming or separation into chamber 15.

As can be seen on FIG. 8A, because of the zig-zag section of the upper wall of channel 12, when there is only a small amount of hydrocarbons floating on the liquid surface, the hydrocarbons tend to come together by coalescence at 15*b* in the peaks of the triangles forming the zig-zags.

It is these hydrocarbon strings or bands shown at 15*b* which end up at 15*a* in the upper region of the decanting chamber to facilitate efficient operation.

Figures 13, 14:
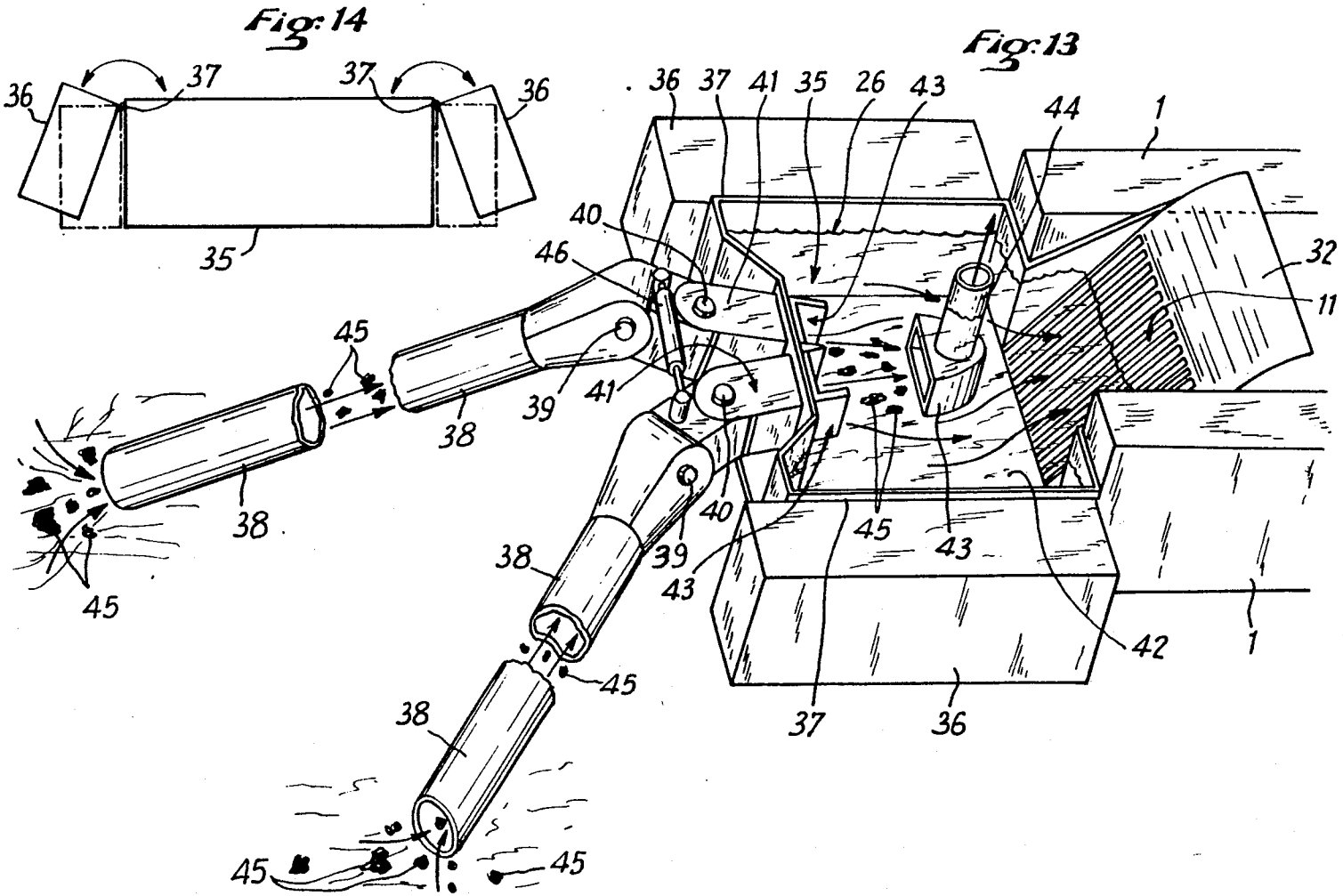
FIG. 13 is a schematic view in perspective of the device which is placed in front of the apparatus to collect wastes whose density is greater than that of the surface layer of water.
FIG. 14 is a schematic view showing adjustment of the elevational position of the device of FIG. 13 by rotating tanks at the sides of the device.

FIGS. 13 and 14 show the device which may be placed in front of the apparatus to allow for elimination of solid wastes 45 which are not floating on the surface of the water, and which have a density greater than water.

To install the device of FIG. 13, caissons 10 which function to channel the surface wastes toward grill 11, are first removed.

The device which is then placed in front of the apparatus is composed of a tank 35 fastened to the front of the apparatus by any appropriate means.

This tank 35 has an open top and discharges through a lateral opening onto grill 11.

Two caissons 36 are mounted on the tank 35 by being hinged or otherwise articulated to the tank along a top inner edge 37, as shown in FIG. 14.

A device, not shown, allows caissons 36 to be immobilized in any angular position with respect to tank 35, which allows the position of the device of FIG. 13 relative to the water to be adjusted at will, and which greatly facilitates its installation and its fastening to the front of the apparatus.

Two tubes 38, long enough so that their lower ends reach to the bottom of the body of water, are connected by pivot means 39 with a vertical axis 40 to passages 41 of essentially square working sections which penetrate tank 35 along converging directions.

The lower wall of passages 41 is advantageously located at the level of bottom 42 of tank 35.

In the embodiment shown, vertical walls 43 extend passages 41 toward the interior of the tank 35.

At the point of convergence of passages 41, receptacle 35 has, attached to its base 42, a collector 43' whose opening faces passages 41. A pipe 44 is connected to the upper portion of collector 43'.

Conforming to the invention, the propellers 20 which are located in the diverging conduits draw out the water from receptacle 35 and create a strong current in tubes 38.

Acting as an aspirator, this current causes the wastes 45 which have a greater density than water and which are found on the bottom, to be drawn into the tubes.

These wastes 45 rise at great speed in tubes 38 and are precipitated into the opening of collector 43' where they are sucked up along with a certain amount of water by pipe 44 which ends in a suction pump, not shown.

While wastes 45 are thus eliminated, most of the water sucked up by the tubes 38 flows through grill 11, being drawn by propellers 20.

An hydraulic cylinder 46 allows an alternative or sweeping movement to be imparted to tubes 38 along the bottom of the water, due to the action of deflectors 21 while the apparatus is driven in reverse at low speed.

During this operation, it is often useful to send air under pressure to the outlet of diverging conduits 18 to oxygenate the water coming from the bottom to regenerate it.

It will be seen that the apparatus according to the invention, is a simple and inexpensive structure, and allows a body of water to be completely decontaminated of all non-soluble wastes, whether these wastes are hydrocarbons, or other solid or viscid wastes, or objects floating on the surface or resting on the bottom.

Moreover, by means of the suction tubes 38 conforming to the invention, it is possible to eliminate most of the plants and algae with proliferate on the bottom, thereby allowing the fauna and the flora of the surface to be regenerated.

Of course, the embodiments, which have been described above are in no way limiting and can undergo various modifications without exceeding the scope of the invention.

In particular, it is clear that instead of using buoyancy tanks constituted of wheel supplied with caterpillar treads which give the apparatus an amphibious character, it is possible to use simple tanks which are acted on in the same way by jacks to regulate the position of the apparatus.

We claim:

1. A decontamination apparatus incorporating a skimmer body including a front end and a rear end suitable for cleaning a body of water having liquid waste floating thereon, said apparatus comprising:

means defining at least one water stream channel having an inlet for receiving a stream of water from said body of water at the front end of the skimmer body and a discharge outlet at the rear end of the body, propeller means for drawing said water stream into said inlet and for discharging said water stream from said discharge outlet, means defining a closed decanting chamber constructed and arranged so as to be located above the surface of the body of water, rearwardly of the inlet of said water stream channel means, means defining a skimming channel having a closed section for collecting an upper part of the water stream containing said floating liquid wastes, said skimming channel having an inlet connected to the upper part of said water stream channel means constructed and arranged so as to be located at a point beneath the level of the body of water surrounding said decontamination apparatus, said skimming channel being inclined upwardly and having an outlet located near the upper part of said closed decanting chamber, whereby floating wastes can accumulate in the upper part of said chamber, a discharging duct means for discharging floating wastes from the top of said decanting chamber, and means defining a closed descending evacuation duct for the water,, said duct having an inlet located in the decanting chamber beneath the outlet of said skimming channel, and having an outlet connected to said water stream channel downstream from the inlet of said skimming channel, at a location constructed and arranged such that the water stream speed is higher than at the location of said skimming channel inlet, so that the decanting chamber is kept full of liquid, the water flowing through the skimming channel being continuously evacuated through said evacuation duct.

2. An apparatus according to claim 1, wherein said decanting chamber has a parallelepipedic shape with a front wall directed toward the front end of the skimmer body and said skimming channel has an elongated section and is located along the front wall of said decanting chamber.

3. An apparatus according to claim 1, wherein the evacuation duct has a cross section smaller than that of the decanting chamber, the inlet of said evacuation duct being located near the center of said decanting chamber.

4. An apparatus according to claim 1, wherein the decanting chamber comprises a float having a density less than that of water but greater than that of the liquid floating waste, and a pump controlled by said float for evacuating liquid floating wastes through said discharging duct.

5. An apparatus according to claim 1, wherein the water stream channel has a working section which progressively diminishes in cross-section from the location of the skimming channel inlet to the location of the evacuation duct outlet in said water stream channel.

6. An apparatus according to claim 1, further comprising an adjustable shutter means for controlling differences in the water stream speeds between the skimming channel inlet and the evacuation duct discharge, said shutter means controlling the flow of water entering from beneath the apparatus into the water stream channel through an additional inlet in the bottom wall of the water stream channel between the skimming channel inlet and the evacuation duct discharge.

7. An apparatus according to claim 1, wherein a portion of the water stream channel comprises an upper wall having undulations transverse to the stream direction between the water stream channel inlet and the skimming channel inlet.

* * * * *